US009205553B2

(12) United States Patent
Ou

(10) Patent No.: US 9,205,553 B2
(45) Date of Patent: Dec. 8, 2015

(54) TOOL SUSPENSION DEVICE

(71) Applicant: Yu-Hua Ou, Taichung (TW)

(72) Inventor: Yu-Hua Ou, Taichung (TW)

( * ) Notice: Subject to any disclaimer, the term of this patent is extended or adjusted under 35 U.S.C. 154(b) by 0 days.

(21) Appl. No.: 14/226,057

(22) Filed: Mar. 26, 2014

(65) Prior Publication Data

US 2015/0273683 A1 Oct. 1, 2015

(51) Int. Cl.
*B25H 3/04* (2006.01)

(52) U.S. Cl.
CPC ..... *B25H 3/04* (2013.01)

(58) Field of Classification Search
CPC ..... B25H 3/003; B25H 3/04; B65D 73/0064
USPC ..... 206/372, 376, 378, 806; 211/70.6
See application file for complete search history.

(56) References Cited

U.S. PATENT DOCUMENTS

| | | | | |
|---|---|---|---|---|
| 5,855,285 | A * | 1/1999 | Laird et al. | 211/70.6 |
| 6,386,363 | B1 * | 5/2002 | Huang | 206/378 |
| 6,431,373 | B1 * | 8/2002 | Blick | 211/70.6 |
| 6,854,607 | B2 * | 2/2005 | Tong | 211/70.6 |
| 7,658,284 | B2 * | 2/2010 | Lin | 206/378 |
| 7,669,723 | B2 * | 3/2010 | Kao | 211/70.6 |
| 7,905,354 | B1 * | 3/2011 | Geibel | 206/378 |
| 8,286,807 | B2 * | 10/2012 | Winnard | 211/70.6 |
| 8,336,709 | B1 * | 12/2012 | Geibel | 206/378 |
| 8,733,562 | B2 * | 5/2014 | Kao | 211/70.6 |
| 2014/0190853 | A1 * | 7/2014 | Ernst | 206/378 |
| 2015/0034518 | A1 * | 2/2015 | Kao | 206/372 |

* cited by examiner

*Primary Examiner* — Bryon Gehman

(57) ABSTRACT

A tool suspension device includes a main body, a seat, and a receiving element. The main body has a suspension portion and a receiving groove. The receiving groove has a first positioning portion. The seat has a shape corresponding to a contour of the receiving groove to be received in the receiving groove. The seat further has a second positioning portion corresponding to the first positioning portion for engagement. The seat has a sliding track on a face opposite to the receiving groove wherein the sliding track is received in the receiving groove. The receiving element is slidably disposed on the sliding track and is able to leave the sliding track only via two opposite ends thereof. The receiving element is unable to leave the sliding track when the seat is received in the receiving groove. Thus, cost of molds is reduced.

10 Claims, 4 Drawing Sheets

TOOL SUSPENSION DEVICE

BACKGROUND OF THE INVENTION

1. Field of the Invention

The present invention relates to a tool suspension device having receiving element which is slidable.

2. Description of the Prior Art

A conventional tool suspension device usually includes anti-theft mechanisms. For example, a slidable receiving element is included. The receiving element is prohibited from being removed by a hindering mechanism blocking the receiving element. As disclosed in patent TW M320343, the tool suspension device includes a main body, a sliding track, and a plurality of receiving elements. The receiving elements are slidably disposed on the sliding track. Two ends of the sliding track are positioned to the main body by covers. The receiving elements are unable to be removed from the two ends of the sliding track freely.

However, the device has a complicated structure to have too much components. More specifically, the main body, the sliding track, the receiving elements, and at least two covers are necessary in this disclosure. Furthermore, bolts are also necessary for fixing. If any one of the covers is lost, the receiving element is unable to be blocked anymore. On the other hand, if any one of the covers is removed by tools, the receiving element is able to be easily removed. Besides, due to the specific positions of the covers, the length of the sliding track is constant.

SUMMARY OF THE INVENTION

The main object of the present invention is to provide a tool suspension device which is anti-theft and easy to use.

To achieve the above and other objects, the tool suspension device of the present invention includes a main body, a seat, and at least one receiving element.

The main body has a suspension portion and a receiving groove. The receiving groove has at least one first positioning portion. The seat has a shape corresponding to a contour of the receiving groove to be received in the receiving groove. The seat has at least one second positioning portion corresponding to the first positioning portion to be engaged with the first positioning portion. The seat has a sliding track on a face opposite to the receiving groove. The receiving element is slidably disposed on the sliding track. The receiving element is able to be removed from the sliding track via only two opposite ends of the sliding track. When the seat is received in the receiving groove, the sliding track is at least partially located in the receiving groove so that the receiving element is unable to leave the sliding track. The receiving element further has at least one tool receiving portion on a face opposite to the seat for receiving a tool.

Thereby, when the seat is positioned to the receiving groove, the receiving element is prohibited from leaving the sliding track. Thus, other restriction elements are not necessary in the present invention.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
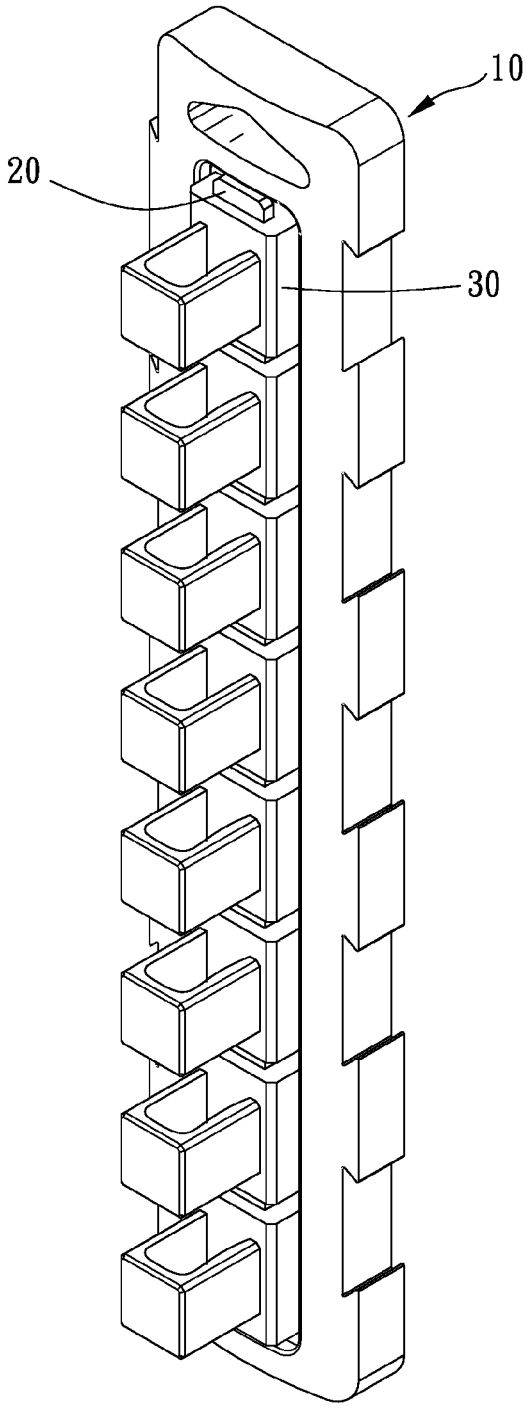
FIG. 1 is a stereogram of the present invention.
Figure 2:
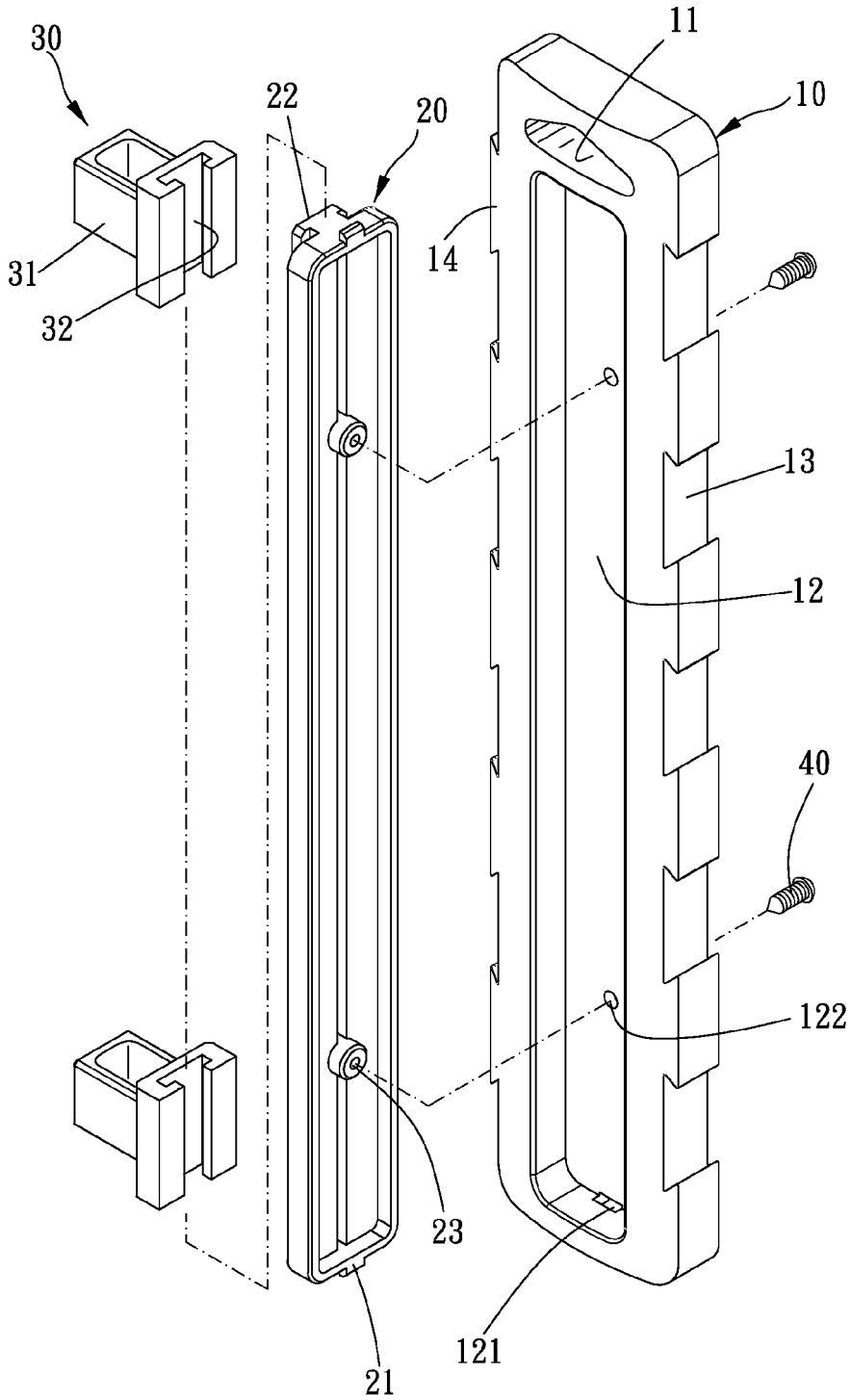
FIG. 2 is a breakdown drawing of the present invention.
Figure 3:
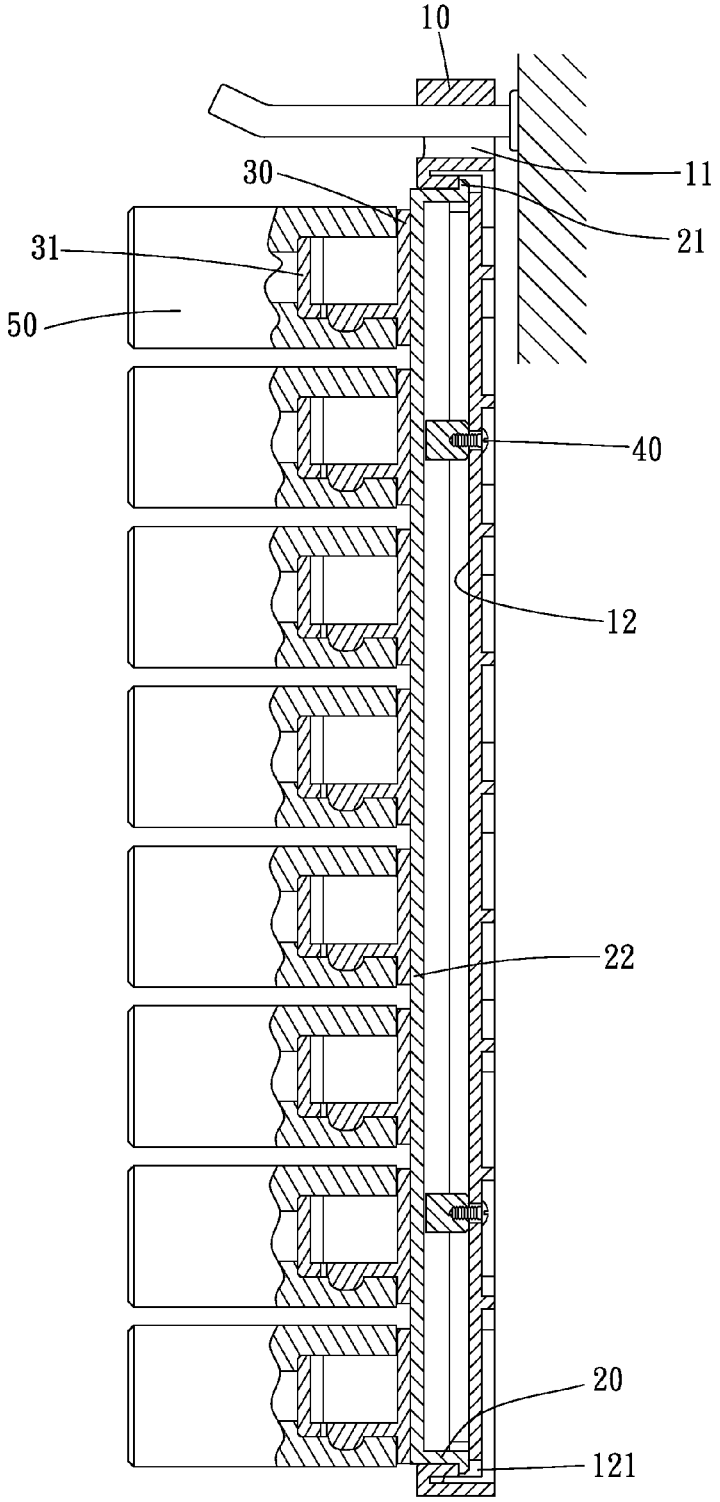
FIG. 3 is a profile of the present invention.
Figure 4:
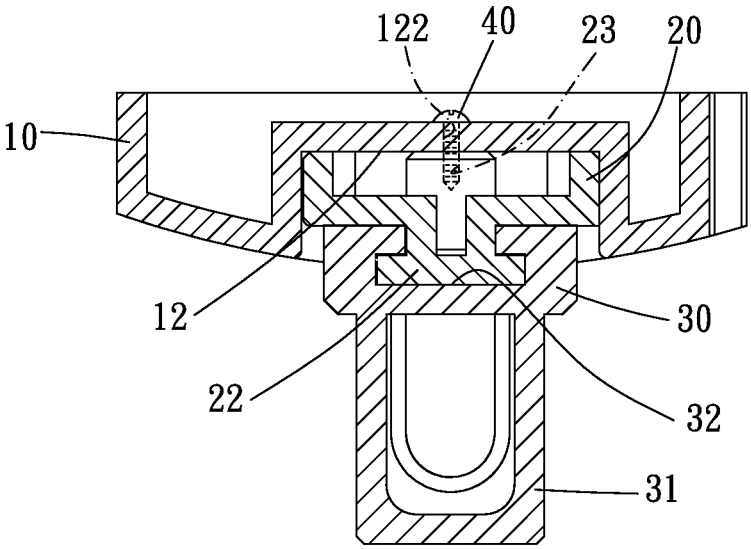
FIG. 4 is a profile at another angle of the present invention.

Please refer to FIG. 1 to FIG. 4, the tool suspension device of the present invention includes a main body 10, a seat 20, and at least one receiving element 30.

The main body 10 has a suspension portion 11 and a receiving groove 12. The receiving groove 12 has at least one first positioning portion. More specifically, in the present embodiment, the main body 10 is substantially rectangle board-shaped. The suspension portion 11 is a suspension hole. However, in other possible embodiments, the suspension portion can be a hook, a magnet, or other structures. On the other hand, the receiving groove 12 is substantially rectangle-shaped. The first positioning portion includes at least one notch 121 formed on a side wall of the receiving groove 12. More preferably, the first positioning portion includes two notches 121 formed on two opposite side walls of the receiving groove 12. The notches 121 are connected with a bottom of the receiving groove 12.

Besides, the main body 10 further has a female engaging portion 13 and a male engaging portion 14 located at two opposite sides of the main body 10. The female engaging portion 13 has a shape corresponding to a shape of the male engaging portion 14. The female engaging portion 13 is adapted for a male engaging portion of another tool suspension device to engage with. The male engaging portion 14 is adapted for a female engaging portion of another tool suspension device to engage with. In the present embodiment, the female engaging portion 13 includes at least one dove-tail-shaped recess, and the male engaging portion 14 includes at least one dove-tail-shaped protrusion. Preferably, the female engaging portion 13 has a plurality of dove-tail-shaped recesses, and the male engaging portion 14 has a plurality of dove-tail-shaped protrusions. Plural tool suspension devices can be assembled into a single piece due to the engagement of the female engaging portion and the male engaging portion.

The seat 20 has a contour corresponding to the shape of the receiving groove 12 and is received in the receiving groove 12. The seat 20 has at least one second positioning portion corresponding to the first positioning portion to be fixed with the first positioning portion. The seat 20 has a sliding track 22 on a face opposite to the receiving groove 12 wherein the sliding track 22 is at least partially received in the receiving groove 12. In the present embodiment, the seat 20 is substantially rectangular board-like. The second positioning portion includes at least one protrusion 21 formed on a side wall of the seat 20. When the protrusion 21 is received in the notch 121, the seat 20 is unable to separate from the main body 10. Preferably, the second positioning portion includes two protrusions 21 located on two opposite side walls of the seat 20. The sliding track 22 is protruded and has a T-shaped cross-section. The sliding track 22 has a smaller width at an end closer to the seat 20 and a larger width at an end more remote from the seat 20. When the seat 20 is received in the receiving groove 12, the narrower portion of the sliding track 22 is located in the receiving groove 12 and is not exposed out of the receiving groove 12.

The receiving element 30 is slidably disposed in the sliding track 22. The receiving element 30 is able to leave the sliding track by only two opposite ends of the sliding track 22. When the seat 20 is received in the receiving groove 12, the sliding track 22 is at least partially located in the receiving groove 12 so that the receiving element 30 is unable to leave the sliding track 22. A face of the receiving element 30 opposite to the seat 20 has at least one tool receiving portion 31 adapted for receiving tools. In the present embodiment, the tool receiving portion 31 includes at least one polygonal protrusion for a socket 50 to be sleeved onto. The receiving element 30 is formed with a sliding groove 32 on a face thereof opposite to the tool receiving portion 31. A width of the sliding groove 32 at an end closer to the opening thereof is smaller than a width of the sliding groove 32 at an end closer to the bottom thereof. The receiving element 30 is slidably disposed on the sliding track 22 with the sliding groove 32. The portion of the sliding track 22 having a smaller width is received in the receiving groove 12 and is not exposed out of the receiving groove 12 so that the receiving element 30 is unable to be removed from the two ends of the sliding track 22.

Besides, to enhance the structural strength, a fixing element 40 is further included. The fixing element 40 fixes the seat 20 and the main body 10 together. In the present embodiment, the fixing element 40 is a bolt. The seat 20 is formed with at least one threaded hole 23 on a face thereof. The receiving groove 12 is formed with a through hole 122 on a bottom thereof. The bolt is inserted through the through hole 122 and screwed with the threaded hole 23 so that the seat 20 is unable to be removed from the main body 10 freely.

In use, the socket 50 is sleeved onto the receiving element 30, and then the receiving element 30 is installed onto the sliding track 22. Alternatively, the receiving element 30 is installed onto the sliding track 22 first, and then the socket 50 is installed onto the receiving element 30. Thereafter, the seat 20 is installed to the receiving groove 12, and the first positioning portion is positioned to the second positioning portion. And then, the fixing element 40 is fastened.

Thereby, the receiving groove is able to receive plural seats at the same time, and the seat is able to correspond to variety of receiving elements. Thus, the tool suspension device can be assembled more freely.

Besides, the receiving element or the seat can be colored to indicate the type or the size of tool it receives. For example, the seat is colored according to the tool type, and the receiving element is colored according to the tool size.

What is claimed is:

1. A tool suspension device, including:

a main body, having a suspension portion and a receiving groove, the receiving groove having at least one first positioning portion;

a seat, having a contour corresponding to a shape of the receiving groove and being received in the receiving groove, the seat having at least one second positioning portion, the at least one second positioning portion corresponding to the at least one first positioning portion to be engaged with the at least one first positioning portion, the seat having a sliding track on a face opposite to the receiving groove, the sliding track being at least partially located in the receiving groove;

at least one receiving element, slidably disposed on the sliding track, the receiving element being removable the sliding track only via two opposite open ends of the sliding track, at least part of the sliding track being received in the receiving groove when the seat is disposed in the receiving groove so that the at least one receiving element is unable to be removed from the sliding track, a face of the at least one receiving element opposite to the seat having at least one tool receiving portion for receiving a tool.

2. The tool suspension device of claim 1, wherein the sliding track is protruded and has a cross-section which is T-shaped, the sliding track has a larger width at an end more remote from the seat than at an end closer to the seat, the at least one receiving element is formed with a sliding groove on a face opposite to the at least one tool receiving portion, the sliding groove has a smaller width at an end closer to an opening thereof than at an end more remote from the opening thereof, the at least one receiving element is slidably disposed on the sliding track with the sliding groove.

3. The tool suspension device of claim 2, wherein the sliding track is totally received in the receiving groove instead of being exposed outside the receiving groove when the seat is received in the receiving groove.

4. The tool suspension device of claim 1, wherein the at least one first positioning portion includes at least one notch formed on a side wall of the receiving groove, the at least one second positioning portion includes at least one protrusion formed on a side wall of the seat, the seat is prevented from being from separating from the main body when the at least one protrusion is received in the at least one notch.

5. The tool suspension device of claim 1, wherein the at least one tool receiving portion is a polygonal protrusion for a socket to sleeve onto.

6. The tool suspension device of claim 1, further including at least one fixing element, the at least one fixing element detachably fixes the seat and the main body together.

7. The tool suspension device of claim 6, wherein the at least one fixing element is a bolt, the seat is formed with at least one threaded hole on a face thereof opposite to the sliding track, the main body is formed with a through hole penetrating a bottom of the receiving groove, the bolt is inserted through the through hole and then threaded to the at least one threaded hole.

8. The tool suspension device of claim 1, wherein the suspension portion is a suspension hole.

9. The tool suspension device of claim 1, wherein the main body has a female engaging portion and a male engaging portion at two opposite sides thereof respectively, the female engaging portion has a shape corresponding to the male engaging portion, the female engaging portion is adapted for a male engaging portion of another tool suspension device to engage with, the male engaging portion is adapted for a female engaging portion of another tool suspension device to engage with.

10. The tool suspension device of claim 9, wherein the female engaging portion includes at least one dove-tail shaped recess, the male engaging portion includes at least one dove-tail shaped protrusion.

* * * * *